United States Patent [19]

Bracken, Jr.

[11] 3,983,694

[45] Oct. 5, 1976

[54] CUP-SHAPED FUEL SLINGER

[75] Inventor: Joseph W. Bracken, Jr., Redford Township, Mich.

[73] Assignee: Eaton Corporation, Cleveland, Ohio

[22] Filed: Oct. 29, 1974

[21] Appl. No.: 518,303

[52] U.S. Cl. ..... 60/39.74 S; 239/216; 239/220; 239/223; 431/168

[51] Int. Cl.[2] ..... F23D 11/06

[58] Field of Search ..... 60/39.74 S; 239/215–218.5, 220, 223; 431/168, 169

[56] References Cited

UNITED STATES PATENTS

| | | | |
|---|---|---|---|
| 2,026,609 | 1/1936 | Cannon | 431/168 |
| 2,055,589 | 9/1936 | Powers | 431/169 |
| 2,705,401 | 4/1955 | Allen et al. | 60/39.74 S |
| 3,204,408 | 9/1965 | Vincent | 60/39.74 S |
| 3,373,562 | 3/1968 | Wormser | 60/39.74 S |

*Primary Examiner*—Carlton R. Croyle
*Assistant Examiner*—Robert E. Garrett
*Attorney, Agent, or Firm*—Teagno & Toddy

[57] ABSTRACT

A generally cup-shaped fuel slinger concentrically secured by its base portion to a rotatable shaft located in a combustion chamber and having a radially inwardly extending lip at its open end provided with a plurality of circumferentially spaced notches opening toward the shaft and spaced at their bottommost portion from the inner annular surface of the slinger side wall. Fuel is delivered by a single tube through the open end of the slinger and is centrifuged outwardly against the inner annular surface of the slinger side wall, and thereafter delivered from the slinger to the combustion chamber through the notches. The slinger is located between a radial turbine and a compressor of a gas turbine engine. The fuel supply tube projects axially through a vane in the diffuser, radially along the diffuser, and then axially into the fuel slinger between the lip and the outer periphery of the adjacent shaft portion. In the disclosed embodiment the notches are generally V-shaped.

9 Claims, 4 Drawing Figures

CUP-SHAPED FUEL SLINGER

BACKGROUND OF THE INVENTION

1. Field of the Invention

This invention relates generally to combustion products of mixed fluid power plants and more specifically to rotating fuel slingers of fuel injection devices for combustion products generators.

2. Description of the Prior Art

Annular combustion chambers are light, inexpensive to manufacture and efficient. In using annular combustion chambers, it is necessary, in order to avoid hot spots which shorten combustion life and cold spots which promote the growth of deposits, to inject fuel uniformly around the chamber.

Uniform fuel injection can be accomplished by using known centrifugal fuel injection systems. One such known centrifugal fuel injection system is illustrated in U.S. Letters Pat. Application Ser. No. 214,703 assigned to the assignee of the present application. That fuel injection system comprises an axially extending circular wall in the shaft assembly of the engine which terminates at a number of radially extending injection passages that project into an annular combustion chamber. The circular wall and passages are an integral part of the rotating compressor-turbine shaft. Centrifugal force causes the fuel to spread out in a layer on the circular wall and flow into the passages. The fuel acquires the tangential velocity of the wall's periphery and is thrown off into the combustion chamber with this velocity. Experience has shown that with such a fuel injection system the hole-to-hole distribution of the fuel is determined by the precision of manufacture of the internal surfaces of the circular wall. Bending of the shaft during rotation will result in eccentricity of the circular wall about the neutral axis causing the layer of fuel to become nonuniform with a fuel buildup along one portion of the circular wall and the thinning out of the fuel along the opposite portion of the circular wall. The nonuniform fuel layer will result in uneven fuel distributing through the passages and can result, in extreme conditions, in the stoppage of flow through some of the passages. When flow is stopped through some of the passages, the feeding passages provide fuel, at any instance, to only a portion of the combustion chamber. This instantaneous partial fuel feeding along with shaft rotation results in the rotation of a flame body around the combustion chamber that is synchronized with shaft speed. Besides reducing combustion chamber efficiency, the rotating flame body condition can also introduce undesirable noise to the operation of the engine. Further, the fuel injection system is relatively expensive to manufacture. Other fuel injection systems that operate in a similar manner are illustrated in U.S. Letters Pat. No. 2,416,389; 2,547,959 and 2,938,345 and French Pat. No. 1,284,281.

Another well known centrifugal fuel injection system, an example of which is illustrated in U.S. Letters Pat. No. 2,659,196, comprises a rotating annular member having radially oriented passages communicating with the combustion chamber and an inner annular reservoir. Fuel is fed to the reservoir by a plurality of fuel delivery tubes that are stationary relative to the engine's housing. Fuel from each delivery tube is projected radially outwardly into the annular reservoir and then through the radially extending passages into the combustion chamber. The centrifugal force causes the fuel to be rapidly ejected through each of the passages over only a small angular portion of each revolution. With such an arrangement it is necessary to use a number of delivery tubes to ensure uniform circumferential fuel injection into the annular combustion chamber.

SUMMARY OF THE INVENTION

It is accordingly an object of the present invention to provide an efficient rotating fuel slinger that can be simply and inexpensively manufactured and readily installed within a combustion chamber.

A more specific object of the invention is to provide a rotating fuel slinger that requires a minimum number of fuel delivery tubes while providing maximum efficiency of fuel distribution.

According to a feature of the invention the fuel slinger is cup-shaped with its base portion secured concentrically to a shaft, and fuel is delivered to the slinger through the annular opening defined between the open end of the annular side wall of the slinger and the adjacent shaft portion. The fuel is thereafter centrifuged outwardly from the slinger into the adjacent combustion chamber.

According to a more specific feature of the invention a plurality of circumferentially spaced passages are provided at the open end of the slinger and communicate at their opposite ends with the interior of the slinger and the combustion chamber. The passages provide the primary path for fuel to flow into the combustion chamber.

According to another feature of the invention, the cup-shaped fuel slinger has a lip at its open end delimiting an annular fuel reservoir, and a number of circumferentially spaced notches are provided in the lip and open into the annular space defined between the lip and the adjacent shaft portion. Fuel is suitably supplied to the annular reservoir, and the notches provide the primary path for fuel to flow from the annular reservoir to the combustion chamber.

According to a more specific feature of the invention the shaft is mounted for rotation within a housing and the fuel is delivered by a single fuel supply tube stationary relative to the housing which projects through the open end of the slinger and terminates at a point adjacent the side wall.

According to another more specific feature of the invention the notches generally diverge in cross section from a point spaced radially inwardly from the side wall of the slinger to the open end of the notches.

DESCRIPTION OF THE PREFERRED EMBODIMENT

Figure 1:
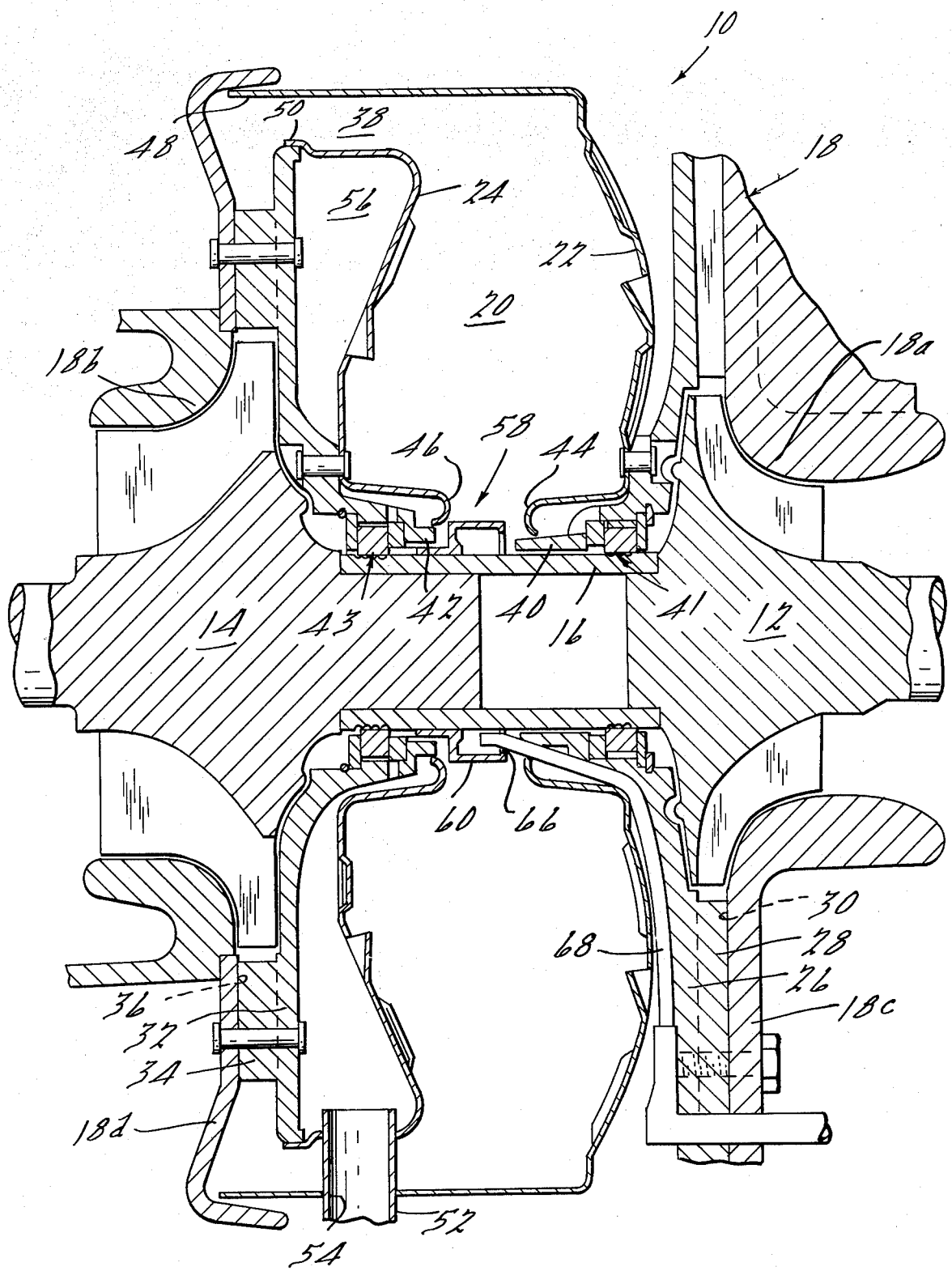
FIG. 1 is a fragmentary, sectional view of a gas turbine engine taken on a plane passing through its center line and embodying features of the invention.
Figure 3:
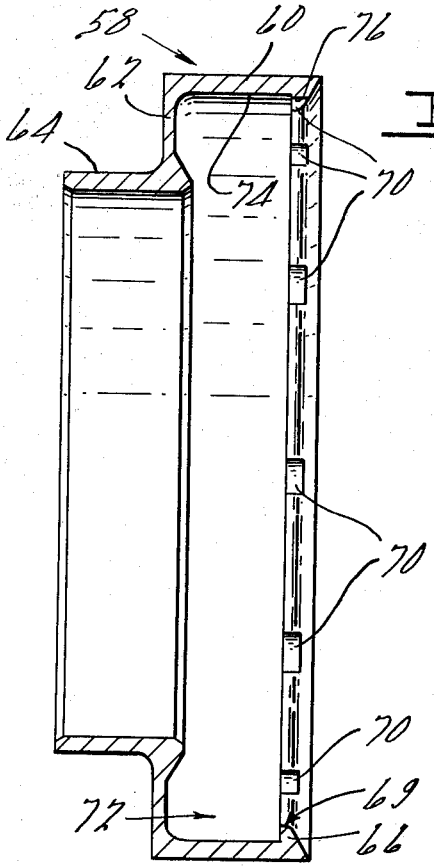
FIG. 3 is a sectional view taken on line 3—3 of FIG. 2.

FIG. 1 illustrates an embodiment of the inventive fuel slinger in combination with a single shaft gas turbine engine 10 having a radial compressor 12 and a radial turbine 14 axially spaced from one another and interconnected via a central circular member 16. Compressor 12 and turbine 14 include stubs which project into complementary openings in central member 16. The compressor and turbine are respectively secured to the central member by inertia welding. Shaft assembly 12, 14, 16 is supported for rotation by known means, not illustrated, and is connected to appropriate power take-off means, not illustrated, to remove shaft horsepower from the engine.

Although a given turbine engine configuration is illustrated, it should be appreciated that the inventive fuel slinger may be used in combination with any annular combustion chamber or may be located within any other combustion chamber in which it is desired to provide a uniform circumferential flow of fluid. The illustration of FIG. 1, therefore, is made only for the purpose of indicating a given environment for the inventive fuel slinger. It should be appreciated that another embodiment of a turbine engine, for example, one of those illustrated in U.S. Letters Pat. No. 2,659,196; 2,720,750; 2,938,345; 3,018,625; 3,115,011; 3,204,408 and 3,321,912 could have also been illustrated for the purpose of describing the invention. The illustrated engine was chosen for the reason that applicant had done development work on an engine similar to the one illustrated in FIG. 1. This similar engine is described and illustrated in U.S. Pat. Application Ser. No. 214,703 assigned to the assignee of the present application.

Referring now in greater detail to FIG. 1, a housing 18 enclosed an annular combustion chamber 20 defined by annular liners 22 and 24. The housing includes portions 18*a* and 18*b* which respectively shroud the blades of compressor 12 and turbine 14. An annular diffuser 26 having cantilever vanes 28 defines together with an annular, radially, extending portion 18*c* of housing 18 a number of radially extending circumferentially spaced diffuser passages 30 which communicate with compressor 12 and combustion chamber 20. An annular nozzle 32 having cantilever vanes 34 defines together with an annular, radially extending portion 18*d* of housing 18 a number of radially extending circumferentially spaced nozzle passages 36 which communicate with an annular axially extending exhaust passage 38 of combustion chamber 20 and turbine 14. Diffuser and nozzle plates 26 and 32 each have an axially extending hub portion, respectively, 40 and 42, that encircles central member 16. Hub portions 40 and 42 are axially spaced relative to one another. A number of known seals 41 and 43, illustrated but not further discussed, are interposed between hub portions 40 and 42 and central member 16 in a known manner.

Each liner 22 and 24 has an inner radial peripheral edge 44 and 46, respectively, circumferentially seated on hub portions 40 and 42 in spaced relationship to one another. The outer peripheral edge 48 of liner 22 is circumferentially seated against a portion of housing 18*d* while the outer peripheral edge 50 of liner 24 is circumferentially seated radially inwardly from outer peripheral edge 48 of liner 22 on nozzle plate 32. Liners 22 and 24 define together exhaust passage 38. A number of circumferentially spaced tubes 52, only one shown, traverse exhaust passage 38. Each tube defines a passage 54 that communicates with compressor 12 and an annular space 56 defined between liner 24 and nozzle plate 32.

An embodiment of the inventive fuel slinger 58 is illustrated in FIG.'S. 1 to 3 as an annular member located within the space defined intermediate hub portions 40 and 42 of diffuser and nozzle plates 26 and 32. Fuel slinger member 58 includes: an annular radially outer generally axially extending side wall portion 60 concentric with the axis of shaft assembly 12, 14, 16; an annular generally radially extending base portion 62 at one end of axial portion 60 that bends into an annular radially inner axially extending portion 64 encircling central member 16; and an annular, generally radially extending lip portion 66 at the other end of axial portion 60 that is spaced from the periphery of central member 16. Inner axially extending portion 64 is secured to central member 16 by shrink fit, welding, fasteners or the like. A single fuel delivery tube 68 projects axially through housing 18, a cantilever vane 28, and diffuser plate 26 and then radially inwardly along a surface of diffuser plate 26 and then axially along hub portion 40 of diffuser plate 26 into the annular space defined between the edge 69 of radially extending lip portion 66 and the outer periphery of the respective encircled portion of central member 16. Delivery tube 68 preferably projects radially upwardly from the base of the engine to ensure that when fuel flow is stopped the fuel in the radially extending portion of the tube will not drain into the fuel slinger. A constant pressure fuel pump, controlled by an appropriate fuel control mechanism, supplies fuel to the passage of delivery tube 68.

Figure 4:
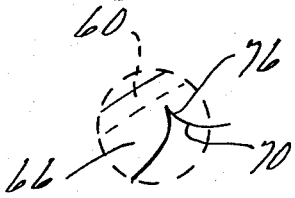
FIG. 4 is a modified view of encircled portion A of FIG. 2.
Figure 2:
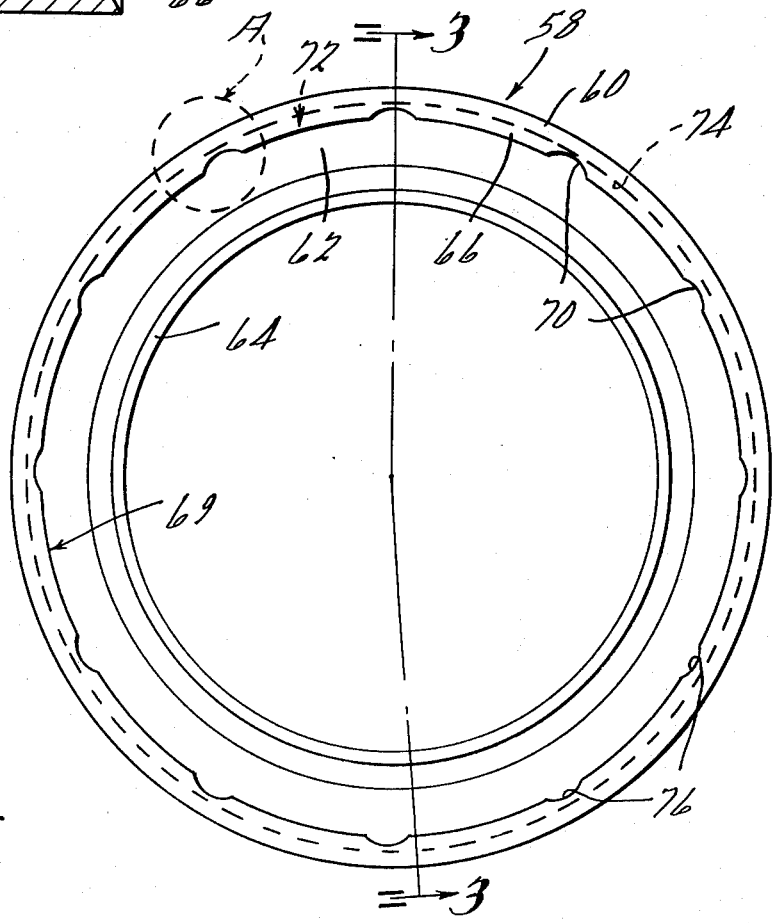
FIG. 2 is an enlarged end view of the entire fuel slinger illustrated in FIG. 1.

Twelve notches 70, equally spaced circumferentially around radially extending portion 66, communicate at one end with annular reservoir 72 defined by an inner circular surface 74 on axially extending portion 60 and radially extending portions 62 and 66. Each notch 70 has a circular shape in cross section opening onto edge 69 and terminates at a radially outer or bottom point 76 that is spaced radially inwardly toward central member 16 from inner circular surface 74. Radially outer points 76 of notches 70 lie on a circle that is concentric with both circular surface 74 and the axis of central member 16. A greater or lesser number of notches 70 may be used. If the number of notches 70 is increased the fuel delivery becomes finer and more uniform and the manufacturing costs increase. If the number of notches 70 is decreased the fuel delivery becomes heavier from each notch and accordingly the manufacturing costs decrease. Notches 70 having other than a circular cross section may be used. For example, notches 70 may be triangular or square in cross section or may have sides having the shape of an exponential curve. An example of a notch 70 having sides the shape of an exponential curve is illustrated in FIG. 4.

Of the various named configurations square notches are least effective for uniform fuel supply and the notches having sides the shape of an exponential curve are most effective for uniform fuel delivery. Further, the notches having sides the shape of an exponential curve provide a constant percentage increase in fuel delivery for every incremental increase in the radial depth of the fuel in the reservoir. The triangular notch is somewhat more effective for uniform fuel delivery than the circular notch.

It has been noted that it is advantageous for uniform fuel delivery during eccentric rotation of shaft assembly 12, 14, 16 around its neutral axis to have notches 70 with a diverging cross section. For example, to provide a given fuel supply in pounds per hour, a given cross-sectional area of all of the notches must be exposed requiring a given radial depth of the fuel reservoir. With triangular notches the depth of reservoir 72 will be greater than it would be with a like number of square notches. As the shaft assembly 12, 14, 16 begins to run off its neutral axis into an eccentric pattern, the fuel in reservoir 72 begins to build up on one side and thin out on the other side. Thus the fuel delivery out of the notches on the buildup side of reservoir 72 will be increased and the fuel delivery of the notches on the opposite side will be decreased. Since shaft eccentricity can be held to given tolerances away from the neutral axis, or at least the amount of eccentricity can be determined, the cross section notches 70 can be accordingly adjusted to ensure that at least some portion of each notch communicates with reservoir 72. Although the flame may be greater on the buildup side of reservoir 72, the divergent cross section of the notches ensure that the flame will not be entirely eliminated on the opposite side thus ensuring greater combustion efficiency than would exist if no fuel was being delivered from the side opposite the fuel buildup.

Fuel slinger 58 may be simply and inexpensively manufactured by stamping it out of sheet metal stock. The notches may be either stamped or machined in the slinger. Further, if desired, the notches may be formed as apertures in radially extending portion 66.

Other arrangements of delivering fuel to reservoir 72 are also contemplated. For example, the fuel may be delivered through radially extending passages in central member 16 as illustrated in U.S. Pat. Application Ser. No. 214,703.

It is believed that it is advantageous to maintain the distance between radially extending portion 66 and the periphery of central member 16 at a minimum. It is thought that the smaller the opening between radially extending portion 66 and central member 16 the lesser the chance that incoming fuel will uncontrollably splash off of fuel slinger 58 and into combustion chamber 20 rather than being propelled, in a controlled manner, radially into the combustion chamber via notches 70. It is important that the fuel be fed through notches 70 and not over the radially inner edge 69 of radially extending portion 66. Accordingly, the minimum number and minimum cross-sectional area of notches 70 should be governed by the maximum fuel flow through the fuel slinger. Further, consideration should be given to shaft eccentricity. The depth of the notches from edge 69 to bottom point 76 should be adjusted to ensure that the fuel flows into the combustion chamber only through the notches and not over edge 69.

What is claimed is:

1. A mixed fluid combustion products generator comprising:

A. an axially extending shaft mounted for rotation;

B. an annular liner defining a combustion chamber encircling a portion of the shaft;

C. a generally cup shaped slinger comprising

1. an axially extending annular impervious side wall portion defining a radially inwardly facing axially extending surface concentric with the shaft axis and radially spaced from the outer periphery of the encircled shaft portion,

2. an annular radially extending impervious base portion secured to the shaft and to the annular impervious side wall portion to define therewith a fuel reservoir communicating with a combustion chamber through an annular opening defined between the inwardly facing surface and the outer periphery of the encircled shaft portion, and

3. means defining a plurality of passages communicating at their one ends with the fuel reservoir and opening at their other ends at a plurality of locations spaced circumferentially about the open end of the cup shaped slinger to provide the primary path for fuel to flow from the inwardly facing surface to the combustion chamber, and D. means for delivering fuel to the fuel reservoir through the annular opening.

2. A mixed fluid combustion products generator comprising:

A. an axially extending shaft mounted for rotation;

B. an annular liner defining a combustion chamber encircling the shaft;

C. a fuel slinger secured to the shaft for rotation therewith and having:

1. an axially extending annular side wall portion defining a radially inwardly facing axially extending surface concentric with the shaft axis and radially spaced from the outer periphery of the encircled shaft portion,

2. means, including an annular radially extending lip portion connected to the axially extending portion and terminating at an annular edge spaced from the outer periphery of the shaft, defining together with the axially extending surface an annular reservoir for retaining fuel, and

3. means defining a plurality of circumferentially spaced notches opening onto the annular edge of the lip portion for providing a path for fuel to flow from the annular reservoir to the combustion chamber; and D. means for supplying fuel to the annular reservoir.

3. A generator according to claim 2 wherein the radially outermost portion of the notches are spaced radially inwardly from the adjacent radially inwardly facing surface.

4. In a mixed fluid combustion products generator having a housing, an axially extending shaft mounted for rotation in the housing, and an annular liner defining a combustion chamber encircling the shaft, the improvement comprising:

A. a fuel slinger secured to the shaft for rotation therewith and having

1. an axial side wall portion defining a radially inwardly facing generally axially extending annular surface concentric with and spaced radially outwardly from the outer peripheral surface of the encircled shaft portion,

2. a radial base portion secured to the shaft and defining a first generally radially extending annular surface extending radially inwardly from the axially extending annular surface to the shaft,

3. a radial lip portion defining a second generally radially extending annular surface extending radially inwardly from the axially extending annular surface at a location spaced axially from the first radially extending surface to define therewith, and with the annular, axially extending surface, an annular reservoir, the lip portion terminating at an annular edge radially spaced from the outer peripheral surface of the shaft and delimiting with the shaft an annular opening, and

4. means defining at circumferentially spaced locations, in the lip portion a plurality of fuel passages communicating at their ends respectively with the reservoir and the combustion chamber, and having, at their radially outermost cross section, surfaces having a radially outer points lying on a circle concentric with and disposed radially inwardly of the annular axially extending surface; and B. means stationary relative to the housing for supplying fuel to the annular reservoir through the annular opening whereby the fuel will build up in the annular reservoir until it reaches the radially outer points whereupon it will discharge through the passages into the combustion chamber.

5. The improvement according to claim 4 wherein the stationary means is a single fuel supply tube terminating at one end intermediate the axially extending surface and the encircled portion of the shaft.

6. The improvement according to claim 4 wherein the passages are notches opening radially toward the shaft into the annular edge and diverging in cross section from the points to the annular edge.

7. The improvement according to claim 6 wherein the notches are arcuate in cross section.

8. The improvement according to claim 6 wherein the notches are generally V-shaped in cross section.

9. The improvement according to claim 6 wherein the notches are defined by surfaces having an exponential curve configuration.

* * * * *